US007530418B2

(12) United States Patent
Ishii et al.

(10) Patent No.: US 7,530,418 B2
(45) Date of Patent: May 12, 2009

(54) CONSTRUCTION MACHINE

(75) Inventors: Hajime Ishii, Kouka (JP); Shigeru Hirasawa, Kouka (JP); Hiroshi Tabeta, Kouka (JP); Shogo Kimura, Kouka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 458 days.

(21) Appl. No.: 10/564,186

(22) PCT Filed: Jan. 28, 2005

(86) PCT No.: PCT/JP2005/001632

§ 371 (c)(1),
(2), (4) Date: Jan. 11, 2006

(87) PCT Pub. No.: WO2005/075753

PCT Pub. Date: Aug. 18, 2005

(65) Prior Publication Data

US 2008/0035401 A1 Feb. 14, 2008

(30) Foreign Application Priority Data

Feb. 4, 2004 (JP) ..... 2004-028347

(51) Int. Cl.
*B62D 33/06* (2006.01)

(52) U.S. Cl. ..... 180/89.12

(58) Field of Classification Search ..... 180/89.12; 296/190.01; 137/625
See application file for complete search history.

(56) References Cited

FOREIGN PATENT DOCUMENTS

| | | |
|---|---|---|
| JP | 7-10054 | 2/1995 |
| JP | 8-74292 | 3/1996 |
| JP | 2000-96626 | 4/2000 |
| JP | 2000-213003 | 8/2000 |
| JP | 2001-40702 | 2/2001 |
| JP | 2001-330004 | 11/2001 |
| JP | 2002-227249 | 8/2002 |
| JP | 2003-41621 | 2/2003 |
| JP | 2003-56011 | 2/2003 |
| JP | 2003-278188 | 10/2003 |

*Primary Examiner*—Faye M. Fleming
(74) *Attorney, Agent, or Firm*—Mattingly & Malur, P.C.

(57) ABSTRACT

A pattern selector valve (32) is lodged in a seat supporting stool (22) which supports an operator's seat (23) thereon, with a switch lever (32B) at a front side of the seat supporting stool. An operator can easily check out the position of the switch lever (32B) of the pattern selector valve (32) at the time of getting onto the operator's seat (23). Besides, the switch lever (32B) of the pattern selector valve (32) can be easily changed over to a different pattern position in the vicinity of the operator's seat (23). Check-out and change-over of the switch lever (32B) are facilitated and can be carried out in a secure manner under guidance of a pattern indicator (39) which is provided on a front cover (34).

10 Claims, 15 Drawing Sheets

CONSTRUCTION MACHINE

TECHNICAL FIELD

This invention relates generally to construction machines, for example, such as hydraulic excavators and wheel loaders, and more particularly to construction machines with a pattern selector valve for switching an operating pattern of manual operating means which control a working mechanism.

BACKGROUND ART

Generally, hydraulic excavators, typical of construction machines, are largely constituted by an automotive vehicular lower structure, an upper revolving structure swingably mounted on the vehicular lower structure through a swing mechanism, a working mechanism built of boom, arm, bucket members liftably provided on a front side of the upper revolving structure and hydraulic cylinders for operating these members.

The upper revolving structure is largely constituted by a revolving frame, an operator's seat provided on the revolving frame, an engine mounted in a rear side of the revolving frame to drive a hydraulic pump, a plural number of control valves mounted on the revolving frame to supply and discharge pressure oil from the hydraulic pump to and from a vehicle drive motor of the vehicular lower structure, hydraulic cylinders of the working mechanism and swing motor of the swing mechanism, and control levers located closely at the right and left sides of the operator's seat to control the control valves for operating the working mechanism and the swing mechanism.

Further, certain hydraulic excavators are provided with a pattern selector valve for switching a pattern of operations of control valves which are hydraulically connected with right and left control levers (e.g., as disclosed in Patent Literatures 1 and 2 below). A pattern selector valve is provided, for example, for switching control levers of a leased hydraulic excavator to an operating pattern which is familiar to or preferred by an operator. Usually, the pattern selector valve is provided in the course of pilot pressure ducts which are connected between a group of control valves and the control levers.

Patent Literature 1: Japanese Utility Model Laid-Open No. S63-135004

Patent Literature 2: Japanese Patent Laid-Open No. 2001-330004

In the case of the prior art hydraulic excavators, a box-like selector valve mount bracket is provided on an engine front cover which covers a front side of an engine, and a pattern selector valve is mounted on the selector valve mount bracket within an engine room in such a way that a switch lever of a manual switch member is located on the rear side. The switch lever of the pattern selector valve can be manually operated after opening a bonnet which covers a rear side of the engine (e.g., as disclosed in Patent Literature 3 below).

Patent Literature 3: Japanese Patent Laid-Open No. 2001-40702

Further, in certain hydraulic excavators, a pattern selector valve is located within a right cover on the right side of an operator's seat. In this case, a switch lever of the pattern selector valve can be manually operated after opening the right cover. Further, in certain hydraulic excavators, an indicator device is provided within a view field of an operator who is seated on an operator's seat, showing a guide to control lever actions in relation with operations of a working mechanism and a swing mechanism, along with a currently selected operating pattern (e.g., as disclosed in Patent Literature 4 below).

Patent Literature 4: Japanese Patent Laid-Open No. 2003-56011

Further, in the case of another hydraulic excavator, a pattern selector valve is accommodated in a space which is formed by stepping up part of a floor panel at the foot and on the left side of an operator who is seated on an operator's seat. In this case, a switch lever of the pattern selector valve can be manually operated by removing a rubber cover which cover the pattern selector valve (e.g., as disclosed in Patent Literature 5 below).

Patent Literature 5: Japanese Patent Laid-Open No. 2002-227249

In the case of the hydraulic excavator according to Patent Literature 3 mentioned above, an operator has to get down from the operator's seat and walk to the rear side of the hydraulic excavator and open the bonnet to check out the position of the switch lever of the pattern selector valve or to operate the switch lever of the selector valve position. This is troublesome and time-consuming. Besides, it takes time in mounting a box-like selector valve mount bracket in the engine front cover, in addition to a higher production cost.

Further, in the case of the hydraulic excavator according to Patent Literature 4 mentioned above, it is possible for an operator, who is seated on an operator's seat, to check out the position of a switch lever of a pattern selector valve on a display. However, in order to manually change over the switch lever of the pattern selector valve, the operator has to get down from the operator's seat and walk halfway around to reach the right side of the hydraulic excavator and open the right cover. The operation of the switch lever requires troublesome and time-consuming efforts.

Furthermore, in the case of the hydraulic excavator according to Patent Literature 5 mentioned above, the pattern selector valve is mounted on an uplifted floor panel portion on the left side of an entrance way to the operator's seat, posing itself as an obstacle to an operator who is getting on or getting off the machine.

DISCLOSURE OF THE INVENTION

In view of the above-discussed problems with the prior art, it is an object of the present invention to provide a construction machine having a pattern selector valve installed in such a way that an operator can check out or change over the position of the pattern selector valve easily in an efficient manner.

(1) According to the present invention, there is provided a construction machine having a vehicular body, a working mechanism liftably provided on a front portion of the vehicular body, a seat supporting stool provided on the vehicular body, an operator's seat mounted on the seat supporting stool to be taken by operator, control valves provided in the course of hydraulic ducts to control the working mechanism by operating oil supply and discharge from a hydraulic pressure source to the working mechanism, manual operating means provided in the vicinity of the operator's seat for operating the control valves to control the working mechanism, and a pattern selector valve provided between the manual operating means and the control valves to permit selection of an operating pattern of the manual operating means in relation with the control valves.

In order to solve the problems as discussed hereinbefore, the construction machine according to the present invention is characterized in that the seat supporting stool is adapted to accommodate the pattern selector valve in an inner space, with a switch member for switching the operating pattern located at a front side of the seat supporting stool.

With the arrangements just described, an operator can easily check out the position of the switch member of the pattern selector valve by taking a look into the seat supporting stool at the time of getting on the operator's seat. Besides, whenever necessary, an operator can change over the position of the switch member of the pattern selector valve easily in the vicinity of the operator's seat, without getting down and walking the rear side of the vehicular body.

Thus, it becomes extremely easy for an operator to check out or change over the position of the pattern selector valve and the operation of switch member of the pattern selector valve, because the check-out or change-over of the pattern selector valve can be made at the time of or after getting on the operator's seat. Moreover, it guarantees for an operator higher reliability and safety in operation.

(2) According to the present invention, preferably the seat supporting stool is internally provided with a selector valve accommodation room for lodging the pattern selector valve therein.

With the arrangement just described, the pattern selector valve is lodged in a selector valve accommodation room within the seat supporting stool, effectively utilizing a space under the operator's seat for the pattern selector valve. Accordingly, one can carry out a maintenance work on the pattern selector valve easily from the front side. In addition, it becomes possible to secure a greater freedom in layout and to downsize the vehicle body.

(3) According to the present invention, preferably the selector valve accommodation room is partitioned in circumference with a box-like shape.

In this case, for example, in the event of oil leaks from the pattern selector valve, leaked oil is prevented from scattering around the operator's seat to guarantee higher reliability and safety in operation.

(4) According to the present invention, preferably the pattern selector valve is accommodated at a position on the side of an entrance way at one side of the operator's seat.

In this case, since the pattern selector valve is located on the side of an entrance way to the operator's seat, it becomes possible to check out or change over the position of the selector valve or to carry out a maintenance or assembling work from the side of the entrance way where a broader working space can be secured.

(5) According to the present invention, preferably front side of the seat supporting stool is provided with an openable front cover adapted to cover the pattern selector valve.

In this case, by the front cover which covers the front side of the seat supporting stool, the equipments which are lodged within the seat supporting stool can be protected from rainwater and dust. Beside, the front cover plays a role of improving the look of the seat supporting stool by concealing the equipments in the stool. Further, in the even of oil leaks from the pattern selector valve, for example, leaked oil is prevented from scattering around the operator's seat to guarantee higher reliability and safety in operation.

(6) According to the present invention, preferably a check-out window is provided in the front cover for checking out current position of the switch member of the pattern selector valve within the seat supporting stool.

In this case, even when the front side of the pattern selector valve is closed by the front cover, one can easily check out the position of the pattern selector valve by confirming a current position of the switch member through the check-out window.

(7) According to the present invention, preferably a transparent member is fitted in the check-out window for covering purpose.

In this case, since the check-out window is covered with a transparent member, equipments within the seat supporting stool are protected from rainwater and dust. Further, in the event of oil leaks from the pattern selector valve, leaked oil is prevented from scattering around through the check-out window.

(8) According to the present invention, preferably a pattern indicator is provided in the vicinity of the check-out window in relation with switching positions of the switch member of the pattern selector valve, showing selectable operating patterns of the manual operating means in relation with the control valves.

In this case, a switch member of the pattern selector valve can be instantly checked out through the check-out window, simply taking a look at the position of the switch member relative to the pattern indicator. Thus, one can check out instantly or change over the position of the pattern selector valve in a secure and facilitated manner.

(9) According to the present invention, preferably a lock mechanism is provided on the front cover for locking same in a closed state.

In this case, the front cover can be kept in a locked state by the lock mechanism, the pattern selector valve is prevented from being inadvertently accessed and changed over by someone else.

(10) According to the present invention, further comprising pilot pressure ducts between the control valves and the manual operating means to supply a pilot pressure from hydraulic pilot valves of the manual operating means to hydraulic pilot portions of the control valve, and a relay assembly interposed between pilot pressure ducts on the side of the manual operating means and pilot pressure ducts on the side of the control valves.

With the arrangements just described, pilot pressure ducts are separately connected between the manual operating means and the relay assembly and between the relay assembly and control valves to facilitate connections of the pilot pressure ducts.

Further, the pilot pressure ducts can cope with both a construction machine with a pattern selector valve and a construction machine without a pattern selector valve, simply changing connection of only pilot pressure ducts alone between the manual operating means and the relay assembly. This means that, on the side of the vehicle body between the relay assembly and the control valves, mount positions of the control valves and connections of pilot pressure ducts on the side of the control valves (on the side of the vehicle body) require no changes, and these parts can be used as common parts with a greater degree of freedom in combinations.

(11) According to the present invention, the seat supporting stool is mounted on a floor panel, and the relay assembly is located on the lower side of the floor panel.

In this case, the relay assembly can be located in a concealed state under a floor panel for the purpose of improving a look of the machine.

BEST MODE FOR CARRYING OUT THE INVENTION

Hereafter, with reference to FIGS. 1 through 11, the present invention is described more particularly by way of embodiments as a construction machine which are applied by way of example to a canopy-furnished hydraulic excavator.

Figure 1:
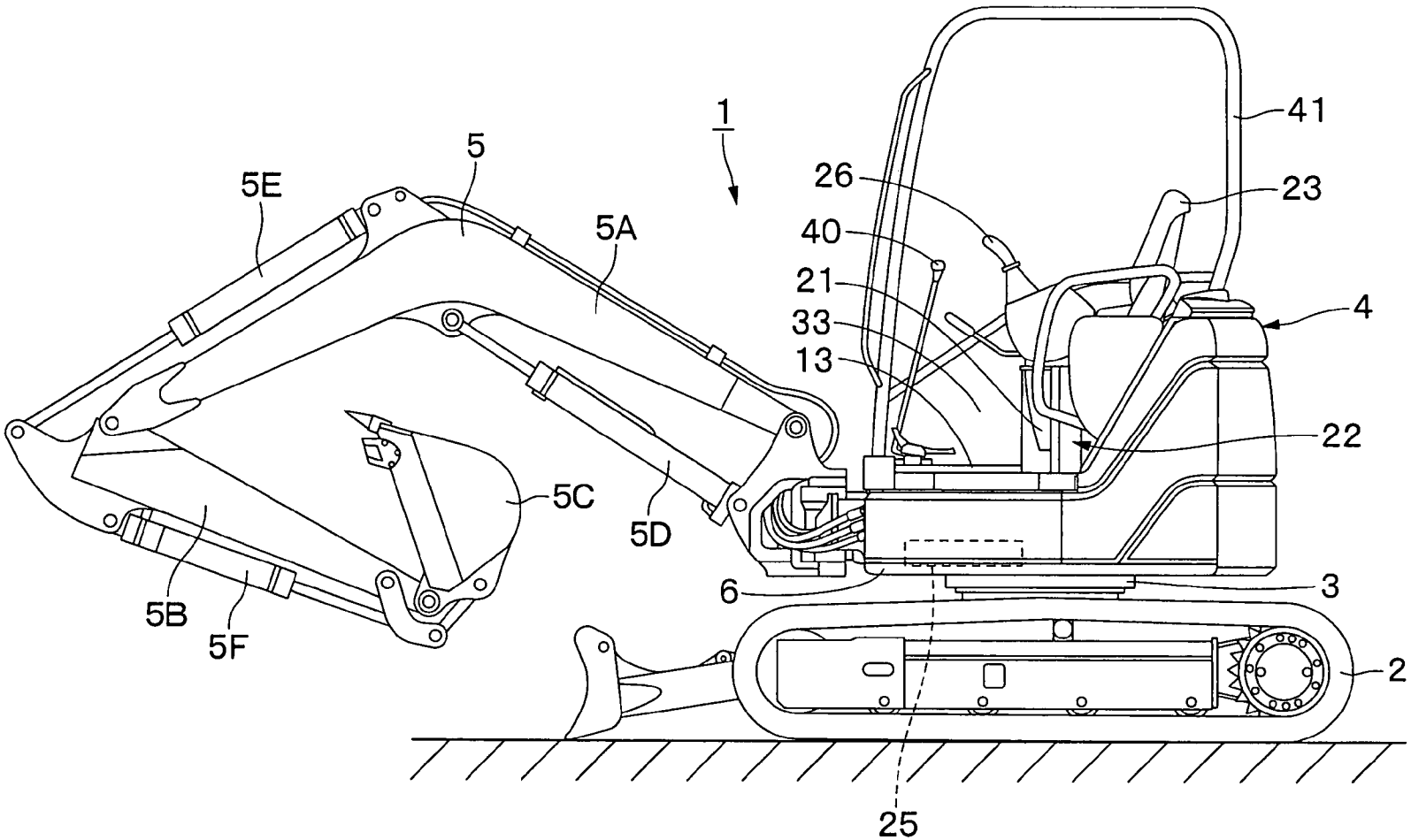
FIG. 1 is a front view of a hydraulic excavator embodying the present invention.
Figure 2:
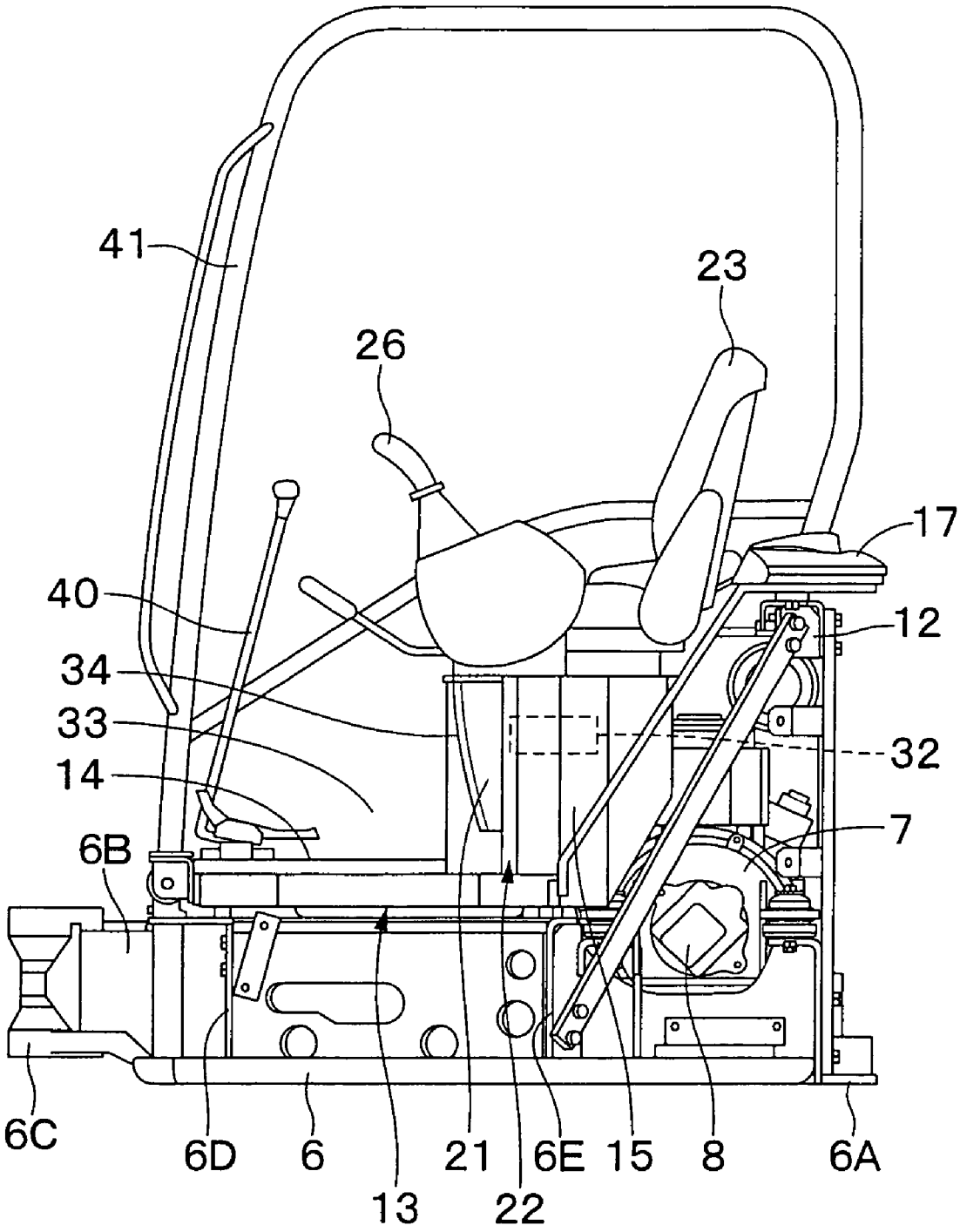
FIG. 2 is a front view of an upper revolving structure having an engine, base unit, operator's seat and a canopy mounted on a revolving frame.
Figure 3:
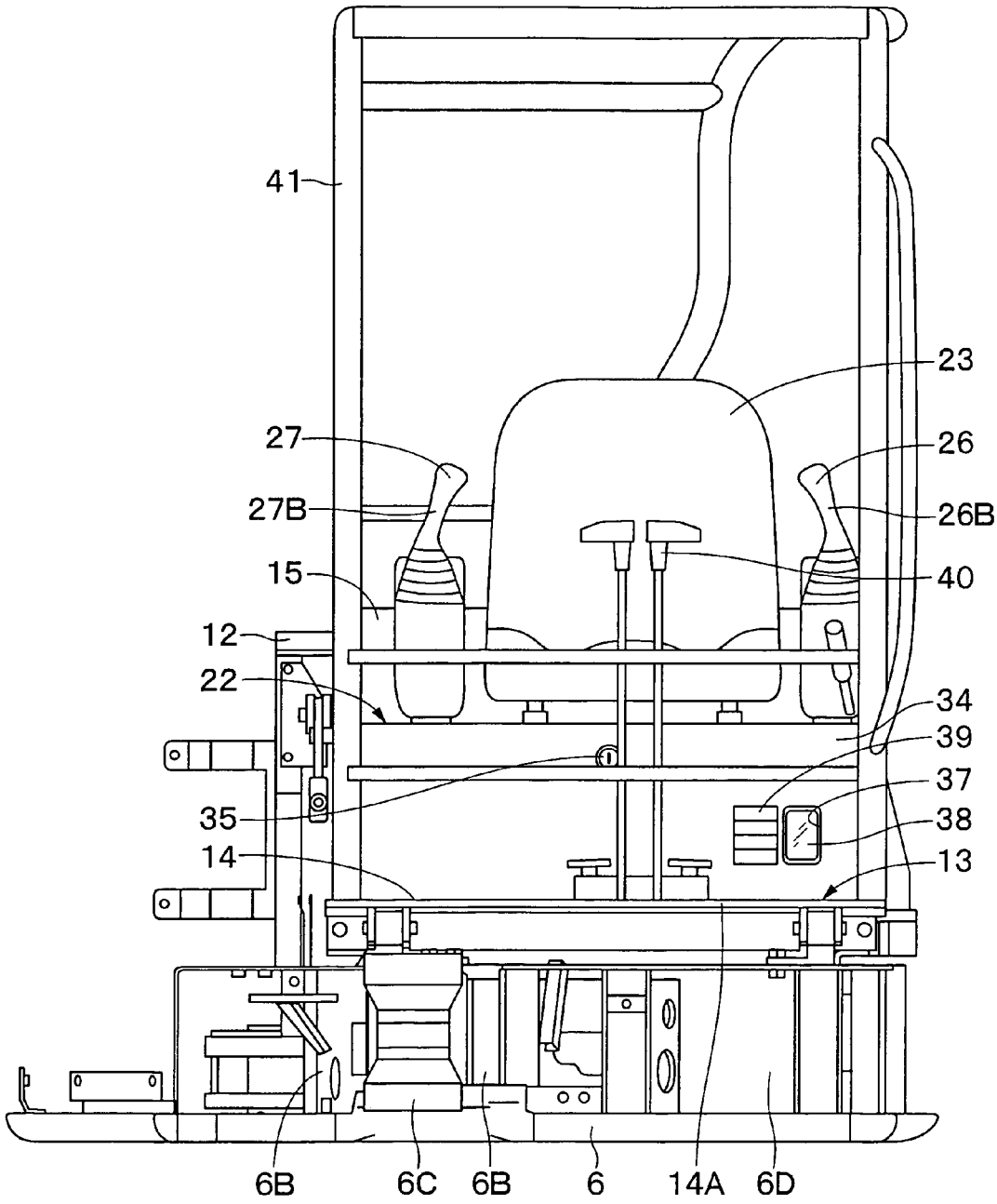
FIG. 3 is an enlarged left-hand side view of the upper revolving structure, with the engine, base unit, operator's seat and canopy mounted on the revolving frame.

In FIG. 1, indicated at 1 is a canopy-furnished hydraulic excavator as a construction machine to which the present invention is applied. This hydraulic excavator 1 is largely constituted by an automotive vehicular lower structure 2, an upper revolving structure 4 which is rotatably mounted on the vehicular lower structure 2 through a swing mechanism 3, and a working mechanism 5 which is liftably provided in a front side of the upper revolving structure 4.

Further, the working mechanism 5 includes a boom 5A which is liftably supported on a front side of a revolving frame 6 which will be described hereinafter, an arm 5B which is pivotally connected to a fore end portion of the boom 5A, a bucket 5C which is pivotally supported on a fore end portion of the arm 5B, a boom cylinder 5D for lifting the boom 5A up and down, an arm cylinder 5E for swinging the arm 5B up and down, and a bucket cylinder 5F for turning the bucket 5C up and down.

Figure 4:
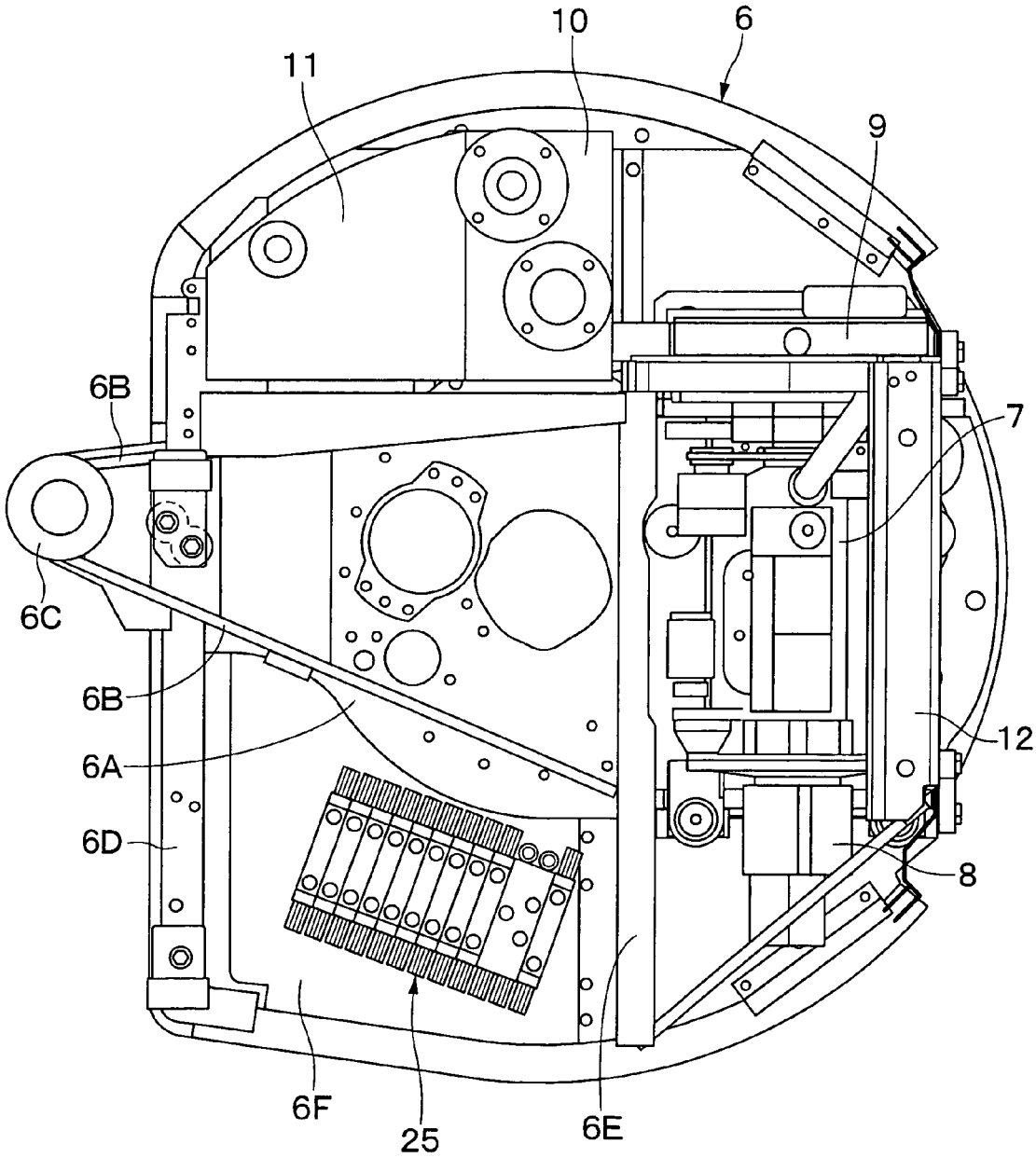
FIG. 4 is a plan view of the upper revolving structure, with the engine, control valves and tank mounted on the revolving frame.

When viewed from above, the upper revolving structure 4 is formed substantially in a circular shape so that it can make swinging turns within a width of the vehicular lower structure 2 (see FIG. 4). Further, the upper revolving structure 4 is largely constituted by a revolving frame 6, engine 7, base unit 13, operator's seat 23, control valves 25, control levers 26 and 27, relay assembly 31, pattern selector valve 32, front cover 34 and check-out window 37, which will be described hereinafter.

Indicated at 6 is a revolving frame which forms a base of the upper revolving structure 4. As shown in FIG. 4, the revolving frame 6 is largely constituted by a bottom plate 6A in the form of a flat plate which is located in a transversely intermediate portion to extend toward fore and rear ends, a pair of vertical plates 6B which are erected in laterally spaced positions on the top side of the bottom plate 6A, a bracket 6C which is provided at the fore ends portion of the vertical plates 6B to support a working mechanism 5, a front beam 6D which is extended in lateral directions at the front side, an intermediate beam 6E which is extended in lateral directions located at the rear portion of the vertical plates 6B, and an under cover 6F which is provided between the front beam 6D and an intermediate beam 6E.

Indicated at 7 is an engine which is mounted on a rear side of the revolving frame 6, taking a transverse mount position to extend in lateral directions. In this instance, the engine 7 is so located as to get under a rear stool member 15 of a base unit 13 which will be described hereinafter. Further, provided on the left side of the engine 7 is a hydraulic pump 8 which is driven by the engine 7, and provided on the right side of the engine 7 a heat exchanger 9 including radiator and oil cooler.

Further, indicated at 10 an operating oil tank which is located on the right side of the revolving frame 6 on the front side of the heat exchanger 9, and indicated at 11 a fuel tank which is located on the front side of the operating oil tank 10. Further, indicated at 12 is a support member which is provided on a rear side portion of the revolving frame 6 to support a rear side position of a base unit 13 which will be described hereinafter.

Denoted at 13 is a base unit which is located on a left side portion of the revolving frame 6. And base unit 6 is supported on the front beam 6D of revolving frame 6 and the support member 12 at its front and rear sides, respectively. As shown in FIGS. 2 and 5 to 7, the base unit 13 is largely constituted by a floor panel 14, rear stool member 15, selector valve accommodation room 16, housing mount plate 17, instrument mount portion 18 and reinforcing pipe 19, which will be described hereinafter.

Indicated at 14 is a floor panel which forms a front side portion of the base unit 13, and this floor panel 14 serves as a foot rest for an operator who is seated on an operator's seat 23 which will be described hereinafter. And the floor panel is provided with a levers/pedals mount portion 14A at its front portion to mount vehicle control levers and pedals 40 which will be described after. Mounted in a left side position on the lower side (back side) of the floor panel 14 is a relay assembly 31 which will be described hereinafter.

Indicated at 15 is a rear stool member which is provided on a rear side portion of the floor panel 14. Along with a front stool member 21 which will be described hereinafter, the rear stool member 15 forms a seat supporting stool 22. Further, the rear stool member 15 is arranged to rise upward from a rear side of the floor panel 14 and then extend rearward over the engine 7. Thus, the engine 7 can be located in such a way as to get under the rear stool member 15.

Figure 7:
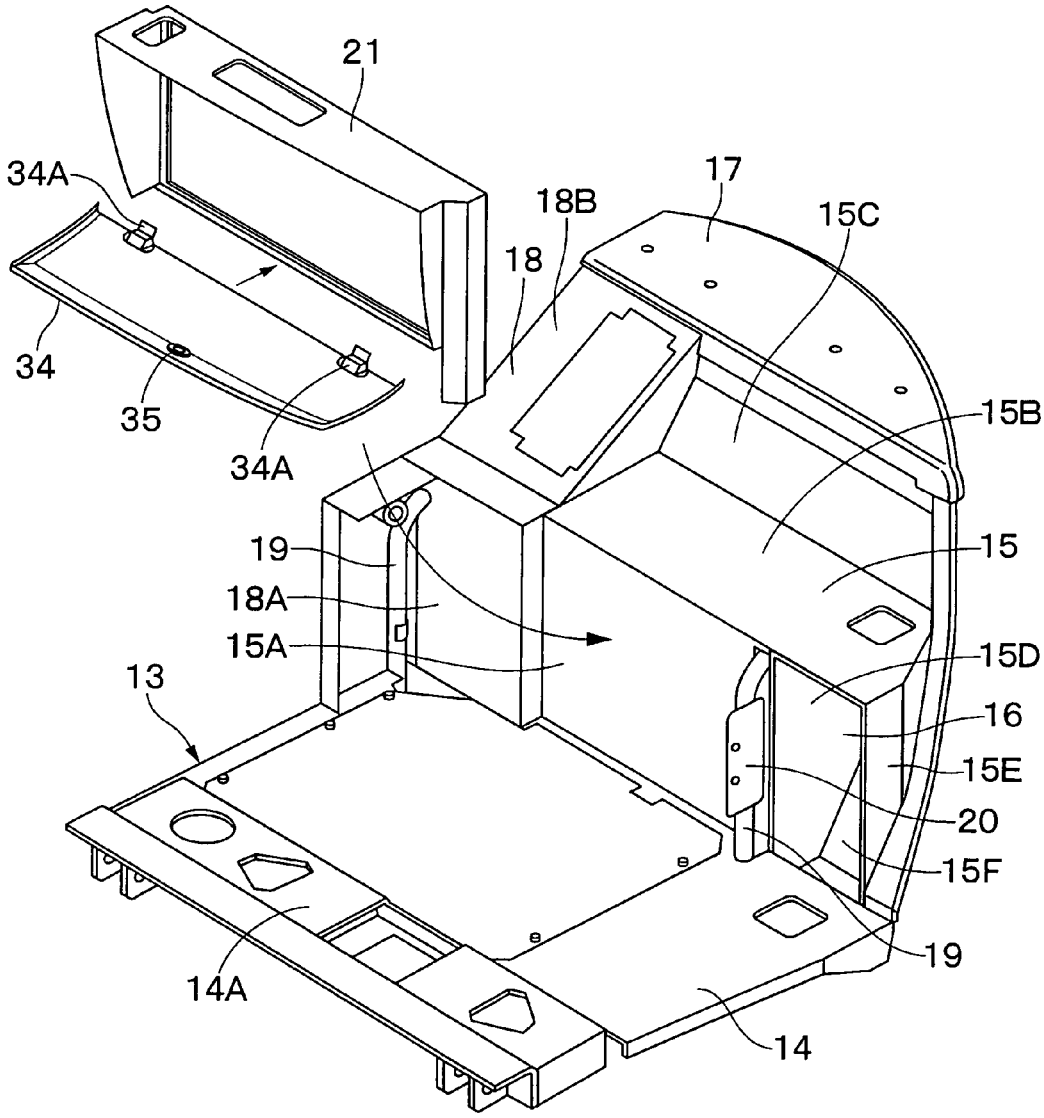
FIG. 7 is an exploded perspective view of the base unit, front stool member and front cover.

More specifically, as shown in FIG. 7, the rear stool member 15 is composed of a riser wall 15A rising upward from a rear end of the floor panel 14, a seat support plate 15B extending rearward from an upper end of the riser wall 15A, a back plate portion extending upward from a rear end of the seat support plate 15B, a partition plate 15D extending rearward from a left end of the riser wall 15A under the seat support plate 15B, a left face plate 15E erected at a spaced position on the left side of the partition plate 15D and connected at an upper end to a left end of the seat support plate 15B, and a rear closure plate 15F closing a rear lower side of the seat support plate 15B between the partition plate 15D and the left face plate 15E.

Figure 6:
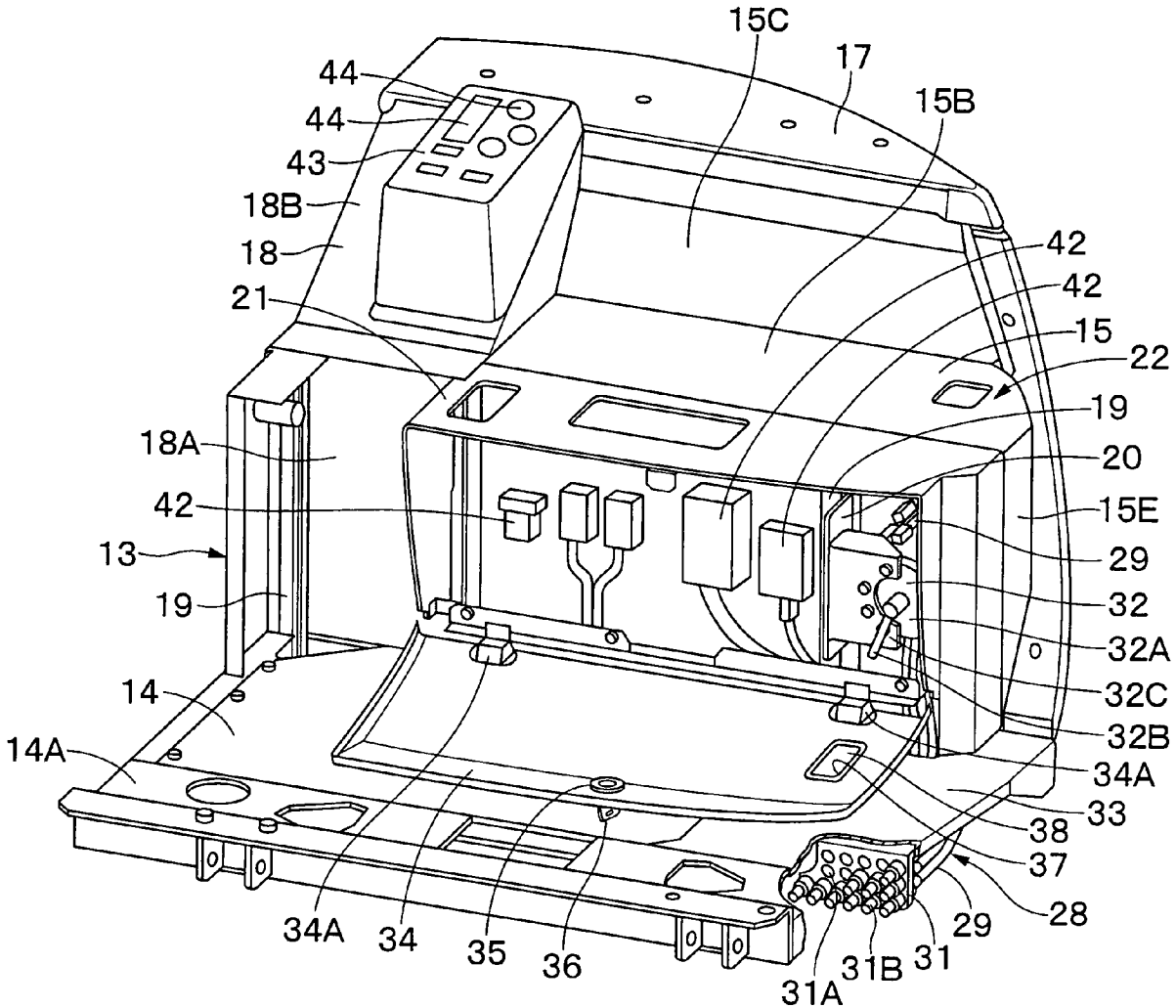
FIG. 6 is a partly cutaway perspective view of the base unit accommodating relay assembly and pattern selector valve, with the front cover of the base unit in an opened state.

As shown in FIG. 6, for example, electrical parts 42, which will be described hereinafter, are mounted on the front surface of the riser wall 15A. Further, mounted on the seat support plate 15B is an operator's seat 23 which will be described hereinafter.

Denoted at 16 is a selector valve accommodation room which is provided at the left side of the rear stool member 15 and on the side of an entrance way 33 to the operator's seat 23, which will be described hereinafter. This selector valve accommodation room 16 defines a space which is open on the front side to accommodate a pattern selector valve 32 which will be described hereinafter. This selector valve accommodation room 16 is partitioned in circumference with a box-like shape, which is enclosed by the seat support plate 15B, partition plate 15D and left face plate 15E and by the rear closure plate 15F at the depth (in a rear side portion).

Thus, a pattern selector valve 32 can be set in the selector valve accommodation room 16, with a switch lever 32B on the front side. Besides, the selector valve accommodation room 16 arranged to have a function of preventing operating oil from scattering around when leaks of operating oil occur to a pilot pressure duct 28 which is connected to the pattern selector valve 32.

Indicated at 17 is a housing mount plate which is jutted rearward from an upper end of the rear stool member 15. The housing mount plate 17 is formed in an arcuate shape from left to rear side along arcuately formed upper revolving structure 4, and supported on a support member 12 on the side of the revolving frame 6. Further, connected to the housing mount plate 17 is a rear side portion of a canopy 41 which will be described hereinafter.

Indicated at 18 is an instrument mount portion which is provided on the right side of the rear stool member 15. This instrument mount portion 18 is largely constituted by a front face plate 18A standing upright on the right side of the riser wall 15A of the rear stool member 15, a sloped or inclined face plate 18B extending obliquely toward the housing mount plate 17 from an upper portion of the front face plate 18A. Instruments such as switches and a monitor (not shown) are mounted on the instrument mount portion 18 through an instrument box 43, which will be described hereinafter.

Indicated at 19 are right and left reinforcing pipes which are provided on the base unit 13 for the purpose of augmenting strength. Each one of these reinforcing pipes 19 is attached to and extended along the floor panel 14, rear stool member 15, housing mount plate 17 and instrument mount portion 18. Major parts of the reinforcing pipes 19 are concealed behind the floor panel 14, rear stool member 15 and housing mount plate 17, and only a part of the reinforcing pipes 19 is exposed on the front side of the rear stool member 15 and instrument mount portion 18. The left reinforcing pipe 19 which is exposed on the outer side of the rear stool member 15 is located in the opening of the selector valve accommodation room 16, and located on the left side of the exposed reinforcing pipe 19 is a mounting plate 20 which will be described hereinafter.

Figure 9:
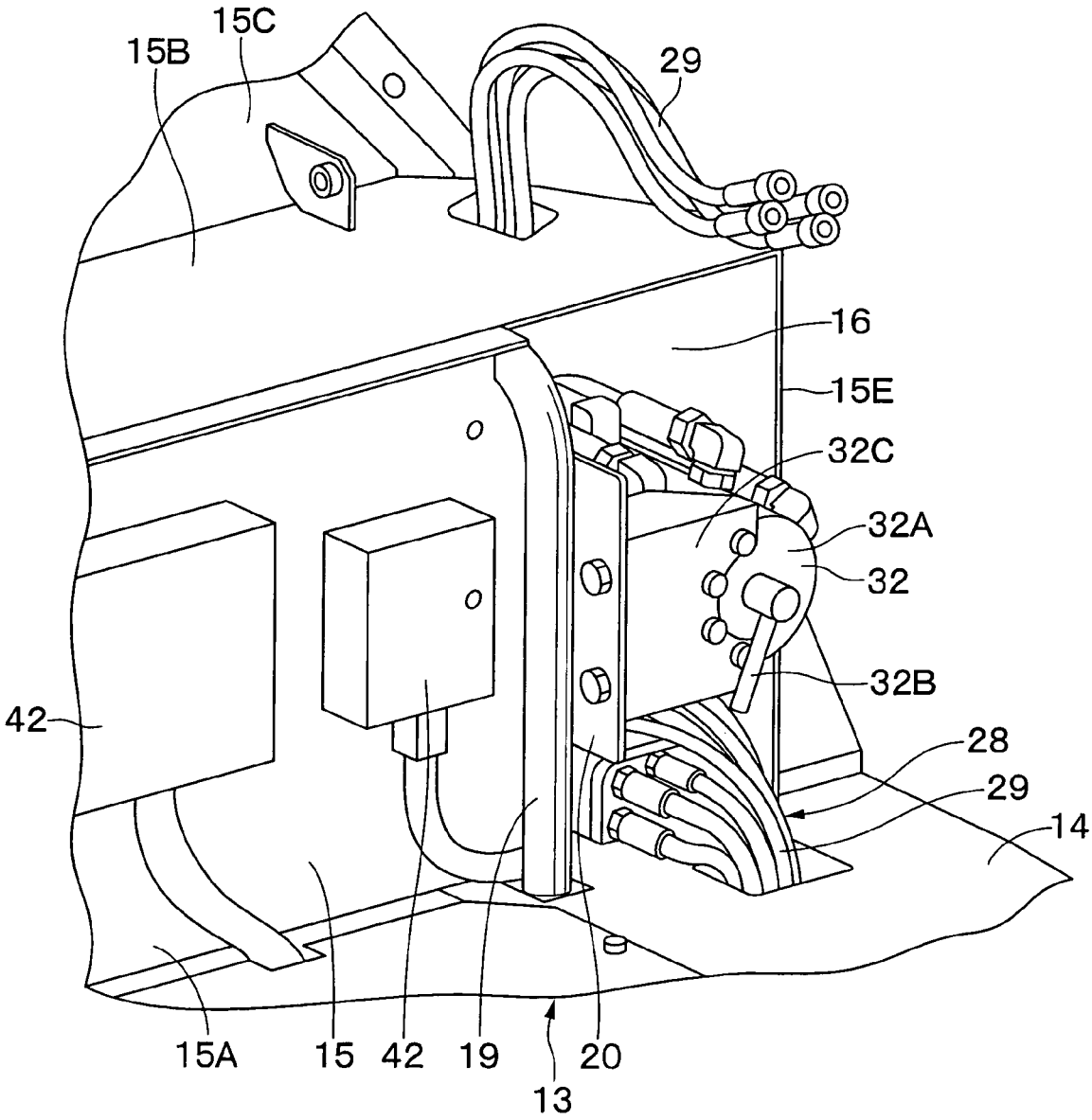
FIG. 9 is an enlarged fragmentary perspective view of the pattern selector valve mounted in the base unit.

Indicated at 20 is a mounting plate which is provided on the left reinforcing pipe 19 and located in the opening of the selector valve accommodation room 16. The mounting plate 20 fixed to the left reinforcing pipe 19 by welding or by the use of screws or other fixation means. Further, as shown in FIGS. 7 and 9, the mounting plate 20 is constituted by a single plate which is extended in the vertical direction. Thus, although simple in construction, the mounting plate 20 is adapted to fix a pattern selector valve 32, which will be described hereinafter.

Further, the mounting plate 20 also serves as a partition plate which partitions off the selector valve accommodation room 16 (the pattern selector valve 32) from electrical parts 42 which will be described hereinafter. Therefore, even in the event of leaks of operating oil from a pilot pressure duct 28 which is connected to the pattern selector valve 32, the mounting plate 20 prevents the leaked operating oil from scattering over electrical parts 42 such as controller and fuses.

Denoted at 21 is a front stool member which is formed in the shape of a frame structure. This front stool member 21 is attached to the front side of the riser wall 15A of the rear stool member 15 which constitutes the base unit 13, and the front stool member 21 constitutes a seat supporting stool 22 together with the rear stool member 15. In cooperation with the seat support plate 15B of the rear stool member 15, the front stool member 21 is adapted to support an operator's seat 23 which will be described hereinafter.

Indicated at 22 is a seat supporting stool which is constituted by the above-described rear and front stool members 15 and 21 of the base unit 13. Further, the seat supporting stool 22 is provided on the upper revolving structure 4 to serve as a stool for mounting an operator's seat 23 which will be described hereinafter.

In this instance, the front stool member 21 of the seat supporting stool 22 is separably attached to the rear stool member 15 to facilitate jobs of mounting the pattern selector valve 32 and electrical parts 42 on the rear stool member 15 and a maintenance work on the pattern selector valve 32 as well. If desired, in place of the separable front and rear stool members 21 and 15, the seat supporting stool 22 may be constituted by a single stool structure integrating the front and rear stool members.

Designated at 23 is an operator's seat which is mounted on the seat supporting stool 22 (see FIGS. 1 and 3), to be taken by an operator at the control of the hydraulic excavator 1. Provided on the right and left sides of the operator's seat 23 are control levers 26 and 27 to be manipulated by an operator for operating the working mechanism 5, as described hereinafter.

Figure 8:
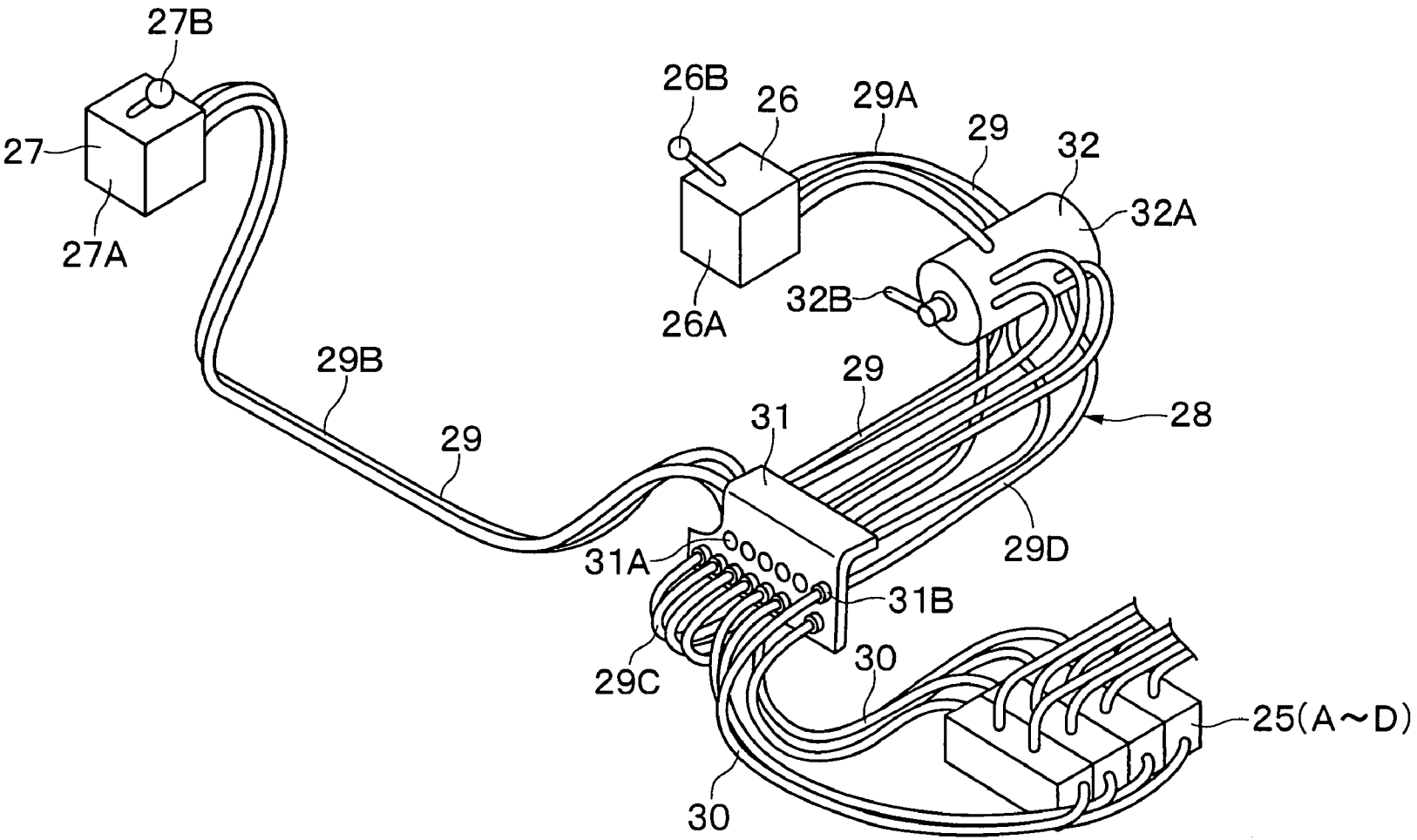
FIG. 8 is a perspective view of pilot pressure ducts, showing connections to control valves, right and left control levers, relay assembly and pattern selector valve.
Figure 11:
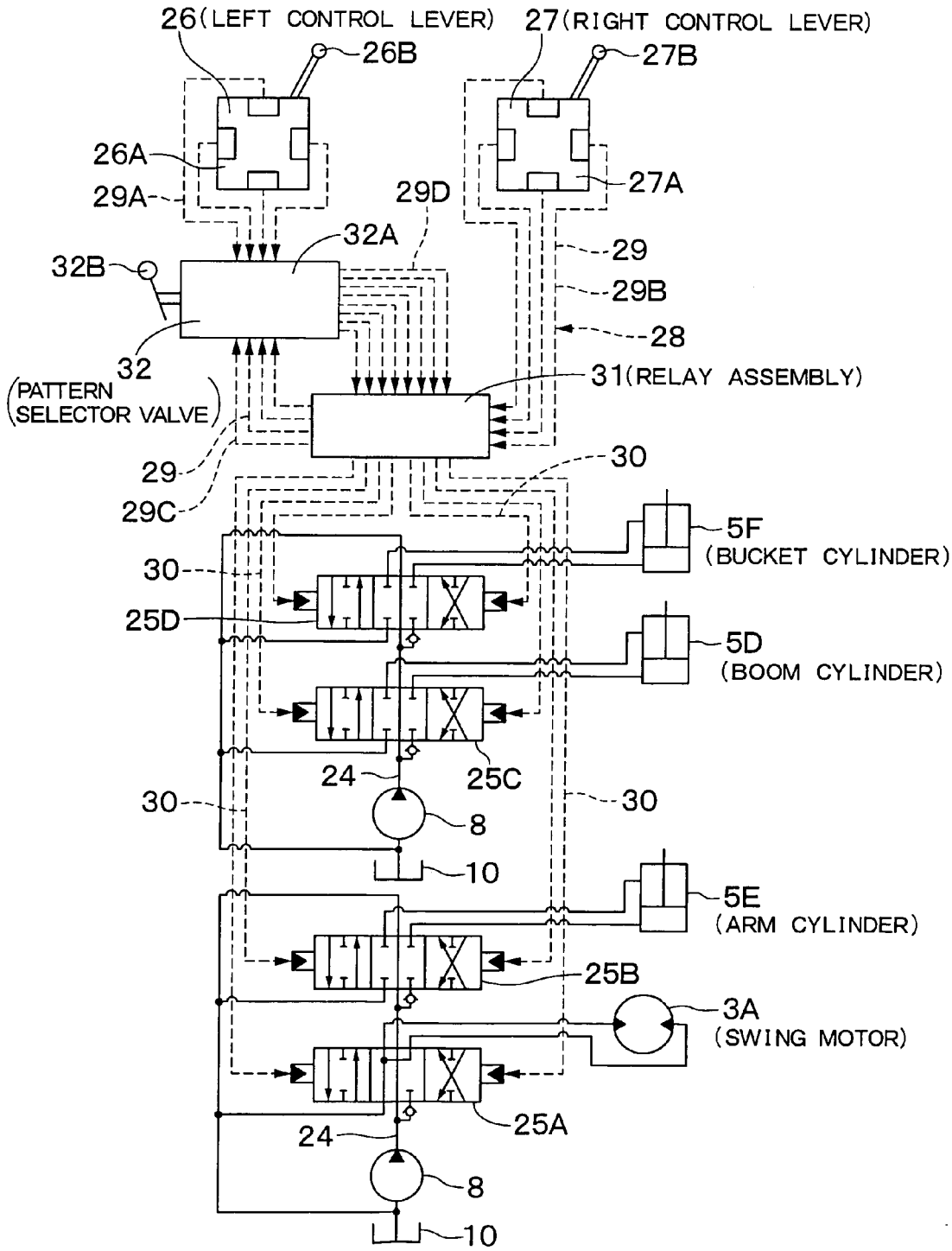
FIG. 11 is a hydraulic circuit diagram of the hydraulic excavator operated by the right and left control levers.

Now, the swing mechanism 3 and the working mechanism 5 are each controlled in the manner as described below with reference to FIGS. 8 and 11.

Indicated 24 is a main duct as an oil passage (see FIG. 11) of pressure oil which is delivered by the hydraulic pump 8. This main duct 24 connects the hydraulic pump 8 with a swing motor 3A of the swing mechanism 3, and cylinders 5D, 5E and 5F of the working mechanism 5.

Denoted at 25A to 25D are a plurality of control valves (herein referred to collectively as "control valves 25") which are located on the revolving frame 6 in the course of the main duct 24. These control valves 25 are each constituted by a hydraulically piloted spool valve. In this instance, the control valves 25 is largely constituted by a swing control valve 25A which controls the swing motor 3A of the swing mechanism 3, an arm control valve 25B which controls the arm cylinder 5E of the working mechanism 5, a boom control valve 25C which controls the boom cylinder 5D, and a bucket control valve 25D which controls the bucket cylinder 5F. Connected to a hydraulic pilot portion of each control valve 25 are ducts 30 on the side of the control valves of a pilot pressure duct 28 which will be described hereinafter.

Indicated at 26 is a left control lever which is provided at the left side of the operator's seat 23 as a manual operating device. The left control lever 26 is largely constituted by a reducing valve type hydraulic pilot valve 26A, and a lever 26B for manually operating the hydraulic pilot valve 26A. As the lever 26B of the left control lever 26 is manually tilted, a pilot pressure is supplied from the hydraulic pilot valve 26A to hydraulic pilot portions of control valves 25 to control operations of two of working units including the swing motor 3A of the swing mechanism 3 and cylinders 5D to 5F of the working mechanism 5.

Further, indicated at 27 is a right control lever which is provided at the right side of the operator's seat 23 as a manual operating device. Similarly to the left control lever 26, this right control lever 27 is largely constituted by a reducing valve type hydraulic pilot valve 27A, and a lever 27B. The right control lever 27 controls remaining two of working units including the swing motor 3A of the swing mechanism 3 and cylinders 5D to 5F of the working mechanism 5.

Indicated at 28 is a plural number of paired pilot pressure ducts which connect the control levers 26 and 27 with a plural number of control valves 25. In this instance, as shown in FIGS. 8 and 11, each pilot pressure duct 28 is dividable into ducts 29 on the side of a manual operating device, connecting the control lever 26 or 27 with a relay assembly 31 which will be described hereinafter, and ducts 30 on the side of control valves, connecting the relay assembly 31 with a control valve 25.

The ducts 29 on the side of the control levers includes left lever ducts 29A which are connected between the left control lever 26 and a pattern selector valve 32, which will be described hereinafter, right lever ducts 29B which are connected between the right control lever 27 and a relay assembly 31, which will also be described hereinafter, intermediate ducts 29C which are connected between the relay assembly 31 and the pattern selector valve 32 and are in communication with the right lever ducts 29B through the relay assembly 31, and selector valve effluent ducts 29D which are connected between the pattern selector valve 32 and the relay assembly 31. The selector valve effluent ducts 29D are connected to the ducts 30 on the side of control valves through the relay assembly 31.

Figure 5:
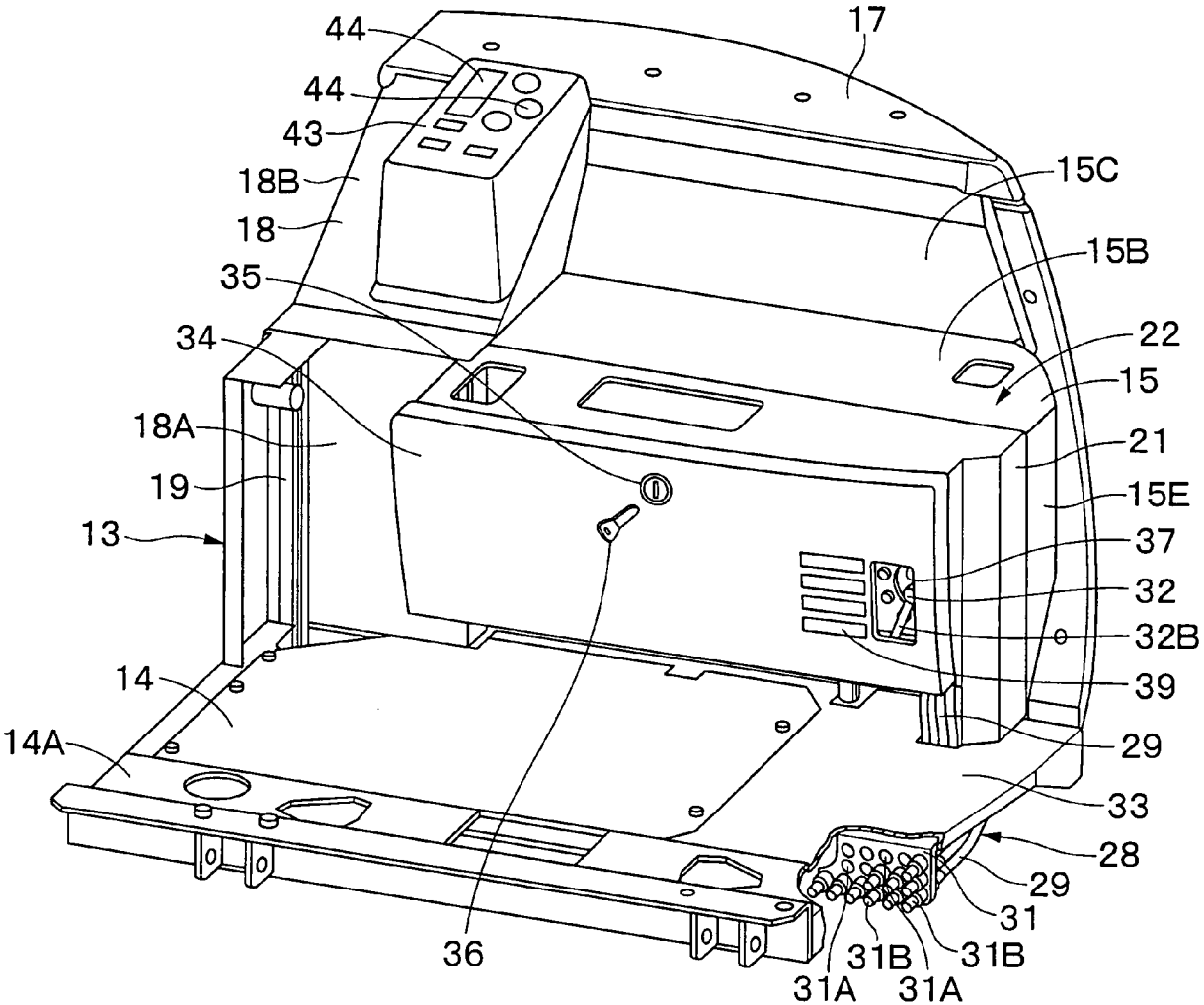
FIG. 5 is a partly cutaway perspective view of the base unit mounting a relay assembly and a pattern selector valve, with a front cover of the base unit in a closed state.

Indicated at 31 is a relay assembly which is provided in the course of the pilot pressure ducts 28, namely, which is provided between the ducts 29 on the side of the control levers and the ducts 30 on the side of control valves. This relay assembly 31 is located in a left side position on the lower side (on the back side) of the floor panel 14. Further, as shown in FIGS. 5, 6 and 8, the relay assembly 31 is constituted by a plate-like body which is bent substantially in L-shape, and a necessary number of joint members 31B anchored in fitting holes 31A which are bored through the plate-like body. Further, the relay assembly 31 separably connects the right lever ducts 29B of the ducts 29 on the side of the control levers with the intermediate ducts 29C, while separably connecting the selector valve effluent ducts 29D of the ducts 29 with the ducts 30 on the side of control valves.

In this instance, the relay assembly 31 is arranged to separably connect the ducts 29 on the side of the control levers with the ducts 30 on the side of the control valves. That is to say, this relay assembly can cope with both a machine with a pattern selector valve 32 and a machine without a pattern selector valve 32, simply by altering only connections of ducts 29 on the side of the control levers. It follows that there is no need for changing connections of the ducts 30 on the side of the control valves or mount positions of the control valves 25.

Indicated at 32 is a pattern selector valve which is provided within the rear stool member 15 of the seat supporting stool 22. By way of this pattern selector valve 32, operating patterns of forward, backward, rightward and leftward movements of the right and left control levers 26 and 27 can be selected in combination with the control valves 25, for example, from four patterns.

In this instance, the operator's seat 23 is located in a left side section on the upper revolving structure 4 of the hydraulic excavator 1. Located on the right side of the operator's seat 23 are operating oil tank 10 and fuel tank 11 or a boom of the working mechanism depending upon the type of the machine. Therefore, usually an operator gets on or off the operator's seat 23 through an entrance way 33 which is provided at the left side of the machine.

Therefore, the pattern selector valve 32 is set in a selector valve accommodation room 16 in a left side of the rear stool member 15, that is to say, on the side of the entrance way 33 at one side of the operator's seat 23 for getting on and off the operator's seat 23. Further, the pattern selector valve 32 is connected and located between the right and left control levers 26 and 27 and the control valves 25. Namely, the pattern selector valve 32 is connected with the intermediate ducts 29C which are in communication with the right and left lever ducts 29B and 29A of the ducts 29 on the side of the control levers, and the selector valve effluent ducts 29D, respectively.

Similarly to a counterpart in the above-mentioned Patent Literatures 1 and 2, the pattern selector valve 32 is largely constituted by a valve casing 32A housing a directional control valve (not shown), and a switch lever 32B as a switch member for manually switching the position of the directional control valve.

Further, as shown in FIG. 9, through the bracket 32C, the valve casing 32A of the pattern selector valve 32 is fixedly mounted on the mounting plate 20 by the use of screws, in such a way that the switch lever 32B is located on the front side which is easily accessible at the time of switching the operating pattern. Thus, an operator can easily check out the position of the switch lever 32B of the pattern selector valve 32 by taking a look at the lower side of the operator's seat 23 before entering the opening of the entrance way 33. In addition, when climbing onto the operator's seat 23, an operator can easily switch the position of the switch lever 32B of the pattern selector valve 32 at a spot in the vicinity of the operator's seat 23.

Denoted at 34 is a front cover which is provided at the front side of the seat supporting stool 22. As shown in FIGS. 5 and 6, the front cover 34 is an openable face plate covering the pattern selector valve 32 in the rear stool member 15 and electrical parts 42 which will be described hereinafter. The front cover 34 is openably connected to lower end portions of the front stool member 21 of the seat supporting stool 22 through hinges 34A which are provided at the lower end of the front cover 34.

Further, indicated at 35 is a lock mechanism which is provided at an upper center of the front cover 34. This lock mechanism 35 is opened and closed, for example, by the use of an engine key 36 (as shown in FIGS. 5 and 6). The use of an engine key can prevent someone else from unknowingly opening the front cover 34 and switching the position of the pattern selector valve 32. Further, in a case where an engine key 36 is used for unlocking the lock mechanism 35, it becomes a must for an operator to turn off the engine 7 at the time of switching the pattern selector valve 32.

In addition, when inserted in the lock mechanism 35, the engine key 36 functions as a knob for opening and closing the front cover 34. Therefore, there is no need for providing a knob which projects on the front side of the front cover 34.

Indicated at 37 is a check-out window which is provided in the front cover 34. This check-out window 37 is an opening enabling an operator to check out the position of the switch lever 32B of the pattern selector valve 32 from outside. Further, the check-out window 37 is provided in a left side portion of the front cover 34, correspondingly to the position of the switch lever 32B of the pattern selector valve 32 which is accommodated in the selector valve accommodation room 16. Thus, even if the front cover 34 is in a closed state, through the check-out window, an operator can easily check out the position of the switch lever 32B of the pattern selector valve 32 behind the front cover.

Further, designated at 38 is a transparent member which is fitted in the check-out window 37 for covering purposes. Although the check-out window 37 is covered, the switch lever 32B of the pattern selector valve 32 can be seen from outside. By the transparent member 38, intrusion of rainwater or dust is prevented during an operation in rain or at the time of car wash. In addition, it can prevent operating oil from scattering around.

Figure 10:
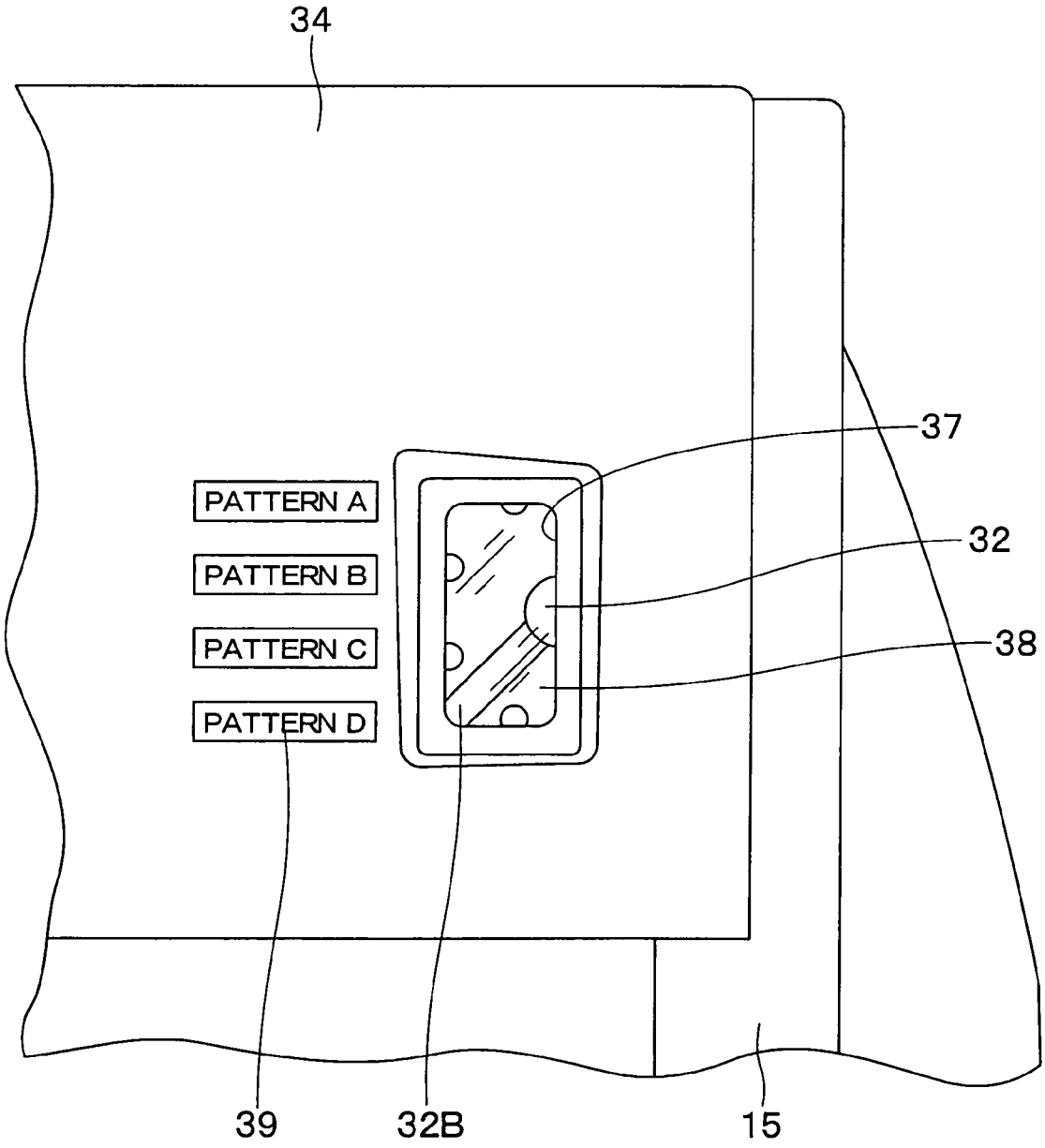
FIG. 10 is an enlarged fragmentary view of a front cover showing a pattern indicator alongside a check-out window.

Denoted at 39 is a pattern indicator which is provided on the left side of the check-out window 37 at front surface of the front cover 34. And, the pattern indicator 39 is showing an operating pattern which is currently selected by way of the pattern selector valve 32 out of four operating patterns, in a simple and accurate manner. More specifically, as shown in FIG. 10, the pattern indicator 39 shows the names of four operating patterns Pattern A to Pattern D in positions corresponding to the switch positions of the switch lever 32B at the time of changing the operating pattern turning the switch lever 32B of the pattern selector valve 32. The pattern indicator 39 may further include a manufacturer's name of the hydraulic excavator 1 or symbolized signs indicating actions of the swing mechanism 3 or the working mechanism 5 in a printed or imprinted form.

Thus, as an operator takes a look at the switch lever 32B through the check-out window 37, he or she can instantly acknowledge which operating pattern is currently selected by taking a look at the pattern indicator 39 corresponding to the switch position of the switch lever 32B.

Indicated at 40 in FIG. 1 are vehicle control levers and pedals which are provided in front of the operator's seat 23. These vehicle control levers and pedals 40 are operated at the time of driving the vehicular lower structure 2. Further, indicated at 41 is a canopy which is built on the revolving frame 6 in such a way as to hang over the operator's seat 23. This canopy 41 can be, for example, a 4-post type canopy having a canopy supported on four posts of which two are located in the front and two are located in the rear.

Further, in FIG. 6, indicated at 42 are a plurality of electrical parts which are mounted on the riser wall 15A of the rear tool member 15, including a controller, fuses and relays. Along with the pattern selector valve 32, these electrical parts 42 are covered by the front cover 34.

Indicated at 43 is an instrument box which is provided on the instrument mount portion 18 of the base unit 13. This instrument box 43 is mounted on the sloped or inclined face plate 18B of the instrument mount portion 18, and instruments 44 such as switches, monitor, lamps are mounted on top of the instrument box.

Being arranged in the manner as described above, the hydraulic excavator 1 of the present embodiment can be put in operation as follows.

In the first place, an operator who is seated on the operator's seat 23 can put the vehicular lower structure 2 in travel by operating the vehicle control levers and pedals 40. Further, the working mechanism 5 can be put in a ground excavation operation by controlling the control valves 25 through manipulation of the right and left control levers 26 and 27.

In this instance, by manipulating the control levers 26 and 27, pilot pressures from the hydraulic pilot valves 26A and 26B are supplied to hydraulic pilot portions of the control valves 25 via pilot pressure ducts 28, relay assembly 31 and pattern selector valve 32 for switching purposes. As a consequence, pressure oil from the hydraulic pump 8 is supplied to and from the swing motor 3A, boom cylinder 5D, arm cylinder 5E and bucket cylinder 5F through the main duct 24 and control valves 25.

At the time of getting on the operator's seat 23, an operator can check the position of the switch lever 32B of the pattern selector valve 32 through the check-out window 37 which is provided on the front cover 34, and can easily confirm the operating pattern of the right and left control levers 26 and 27 from the pattern indicator 39 that a currently selected operating pattern of operator's personal preference.

On the other hand, in case there is necessity for altering operating patterns of the right and left control levers 27 and 26 to patterns of operator's preference, what an operator needs to do is to unlock the lock mechanism 35 of the front cover 34 by inserting an engine key 36 and then pull the engine key 36 forward to open the front cover 34, turning the switch lever 32B of the pattern selector valve 32 to a position of an operating pattern which the operator likes.

Thus, according to the present embodiment, the pattern selector valve 32 is accommodated within the seat supporting stool 22 in such a way that the switch lever 32B is positioned on the front side. In this instance, in order to check out the position of the switch lever 32B of the pattern selector valve 32, what an operator is required to do is to simply take a look at the switch lever 32B and confirm its position through the check-out window 37 at the time of getting on the operator's seat 23. Besides, the switch lever 32B of the pattern selector valve 32 can be easily switched to a different position in the vicinity of the operator's seat 23 without having to get off from the operator's seat 23 and walk around to the rear side of the machine.

Thus, as described above, the position of the switch lever 32B of the pattern selector valve 32 can be checked out or switched in an extremely simplified and facilitated manner at the time of getting on or after the operator's seat 23.

Further, the pattern selector valve 32 is accommodated in the selector valve accommodation room 16 which is openable on the front side, effectively utilizing for the pattern selector valve 32 a space under the operator's seat 23. Therefore, a maintenance work on the pattern selector valve 32 can be carried out easily from the front side of the valve. In addition, it becomes possible to secure a greater freedom of layout and to downsize the vehicle body.

Moreover, the selector valve accommodation room 16 is formed in a box-like shape which is enclosed by the seat support plate 15B, partition plate 15D, left face plate 15E and rear closure plate 15F of the rear stool member 15. Therefore, even if oil leaks occur due to a damage to a pilot pressure duct 28 which is connected to the pattern selector valve 32, the leaked oil is prevented from getting out of the enclosed box-like selector valve accommodation room 16 and scattering around the operator's seat to enhance reliability and safety in operation.

Further, the pattern selector valve 32 is located on the side of the entrance way 33, beside a passage to and from the operator's seat 23. It becomes possible to check out or change the switch lever position or to carry out a maintenance or assembling work on the side of the entrance way 33 where a broader working space is available, enhancing working efficiency.

On the other hand, the front cover 34 which closes the front side of the seat supporting stool 22 plays a role of protecting the pattern selector valve 32 and the electrical parts 42, such as a controller, fuses or the like, in the seat supporting stool 22 against rainwater and dust, in addition to a role of improving the look of the seat supporting stool 22 by concealing the accommodated equipments. Furthermore, for example, in the event of oil leaks from the pattern selector valve 32, leaked oil is prevented from scattering around the operator's seat to guarantee enhanced reliability and safety in operation.

Further, by taking a look through the check-out window 37 which is provided in the front cover 34, an operator can easily check out the position of the switch lever 32B of the pattern selector valve 32 which is accommodated behind the front cover 34. Besides, since the check-out window 37 is covered with the transparent member 38, the pattern selector valve 32 and electrical parts 42 are protected from rainwater and dust. In the event of oil leaks, there is no possibility of leaked oil scattering around the operator's seat.

Further, the pattern indicator 39 is provided on the front cover 34 in relation with positions of the switch lever 32B of the pattern selector valve 32 which provides a number of combinations of operating patterns of the control levers 26 and 27 with the control valves' 25. Therefore, by taking a look at a pattern name on the pattern indicator 39, which is in a corresponding position to the switch lever 32B, an operator can instantly recognize the operating pattern which is currently selected. That is to say, not only check-out but also switching of operating patterns can be carried out in an extremely facilitated manner.

Moreover, the front cover 34 can be locked by the lock mechanism 35 to prevent the pattern selector valve 32 from being inadvertently switched by someone else. Besides, an engine key 36 is required at the time of switching the pattern selector valve 32. This means that the engine 7 is always turned off before making an access to the pattern selector valve, ensuring safety at the time of switching the position of the pattern selector valve. Further, at the time of opening the front cover 34, the engine key 36 which has unlocked the lock mechanism 35 can be used as a knob in opening the front cover. Accordingly, there is no need for providing a knob or a knob-like projecting member on the front cover 34. This contributes to simplify the construction of the front cover and to improve its appearance.

Furthermore, the relay assembly 31 which relays connections of the respective pilot pressure ducts 28 is provided under the floor panel 14 of the base unit 13. Therefore, at the relay assembly 31, the respective pilot pressure ducts 28 are dividable into ducts 29 on the side of the control levers and the ducts 30 on the side of the control valves. This means that it is possible to cope with both a machine with a pattern selector valve 32 and a machine without a pattern selector valve 32, the altering connections of the pilot pressure duct 28 is altering connections of ducts 29 on the side of the control levers alone. It follows that pilot pressure ducts 30 on the side of the control valves can be utilized as a common assembly without changing their connections and mount positions of the control valves 25, and can be provided as common parts with a higher degree of freedom in combinations.

Moreover, the mounting plate 20 forms a partition between the selector valve accommodation room 16 (pattern selector valve 32) and the electrical parts 42, so that, even if oil leaks occur to a pilot pressure duct 28 which is connected to the pattern selector valve 32, the mounting plate can prevent the electrical parts 42 such as controller and fuses from being covered with leaked oil.

Figure 12:
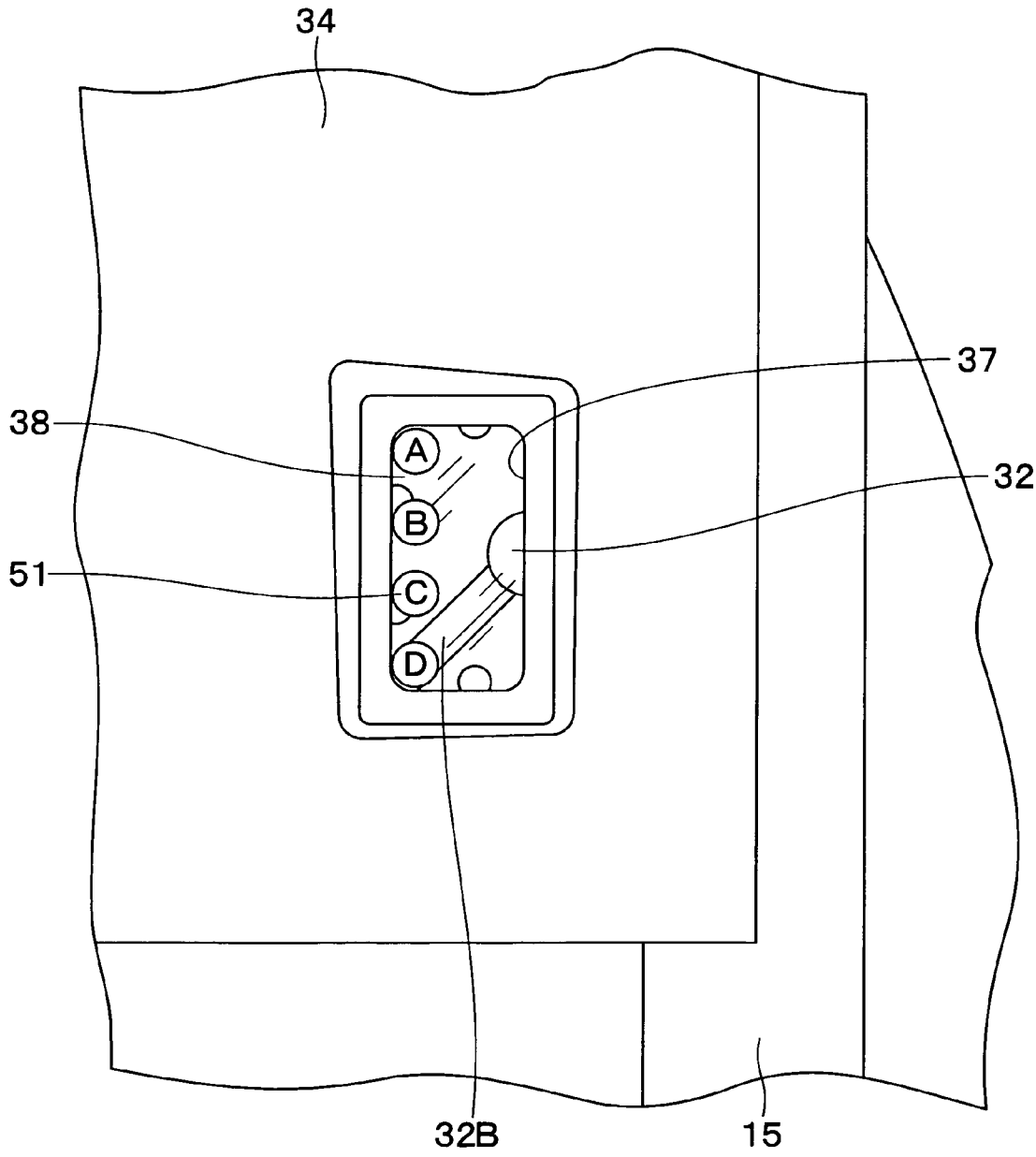
FIG. 12 is an enlarged fragmentary view of a front cover with a pattern indicator according to a first modification of the present invention.

In the above-described embodiment, by way of example the pattern indicator 39 is provided on the left side of the check-out window 37 at the front surface of the front cover 34. However, the present invention is not limited to the particular example shown. For instance, there may be provided a pattern indicator 51 having signs or symbols of operating patterns put on the transparent member 37 as in a first modification shown in FIG. 12. In this case, it desirable to put the signs or symbols of operating patterns on the inner side of the transparent member 38 to avoid attritional erasion of the pattern indicator 51.

Further, in the above-described embodiment, the ducts 29 on the side of the control levers of the pilot pressure ducts 28 are by way of example composed of the left lever ducts 29A which connect the left control lever 26 to the pattern selector valve 32, right lever ducts 29B which connect the right control lever 27 to the relay assembly 31, intermediate ducts 29C which connect the relay assembly 31 to the pattern selector valve 32 and which is in communication with the right lever ducts 29B through the relay assembly 31, and the selector valve effluent ducts 29D which connect the pattern selector valve 32 to the relay assembly 31.

Figure 13:
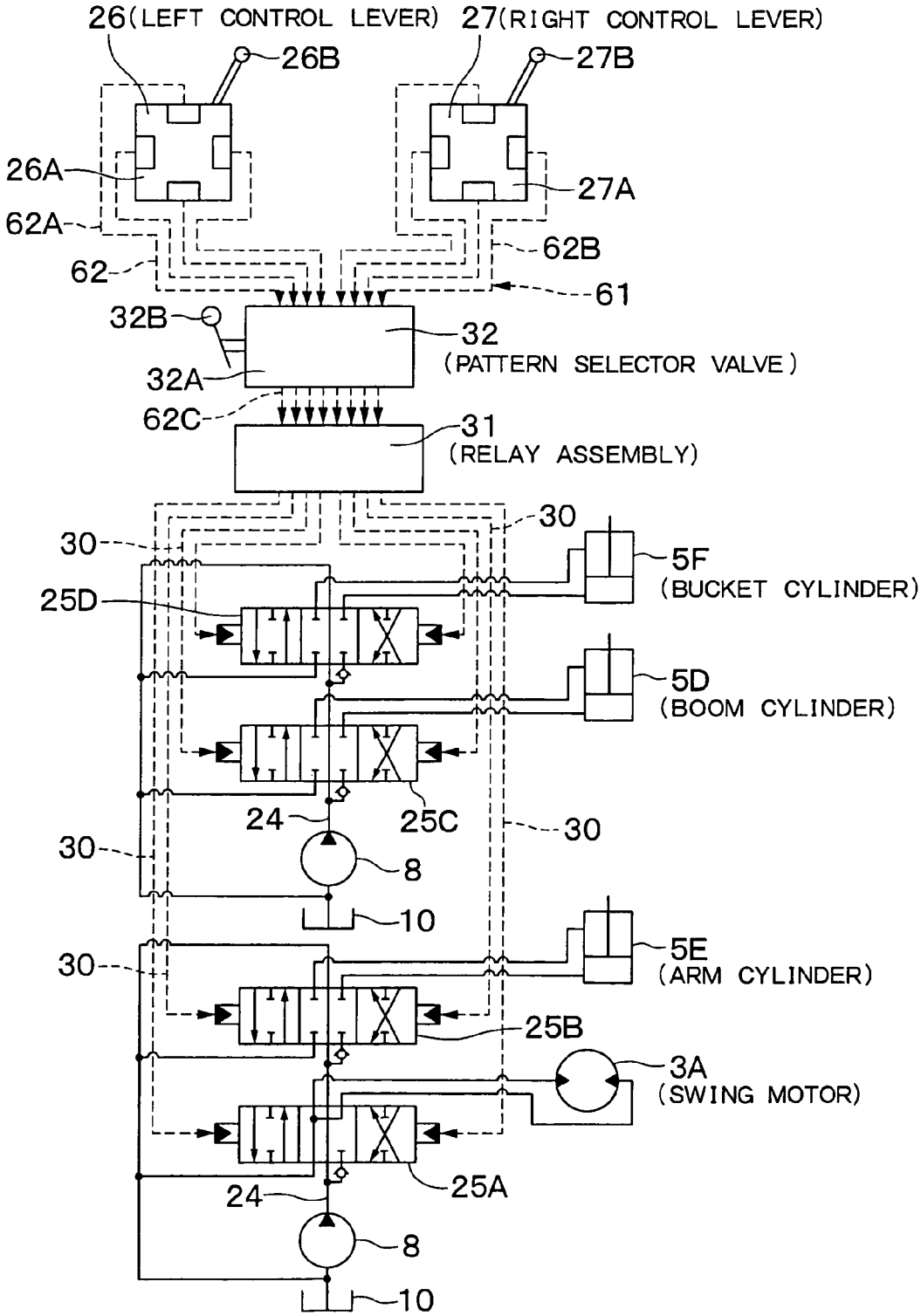
FIG. 13 is a hydraulic circuit diagram showing pilot pressure ducts in a second modification according to the present invention.

However, the present invention is not limited to the particular example shown. For instance, as shown in a second modification of FIG. 13, there may be provided pilot pressure ducts 61 having lever-side ducts 62 composed of left lever ducts 62A which connect the left control lever 26 to the pattern selector valve 32, right lever ducts 62B which connect the right control lever 27 to the pattern selector valve 32, and selector valve effluent ducts 62C which connect the pattern selector valve 32 to the relay assembly 31.

Further, in the above-described embodiment, by way of example the pattern selector valve 32 is shown as a pattern selector valve by which four operating patterns are selectable. However, the present invention is not limited to this particular example. For instance, in the case of an exporting hydraulic excavator, the pattern selector valve may be a 2-pattern type providing two selectable operating patterns. In such a case, the pattern indicator 39 have only Pattern A and Pattern B.

On the other hand, in the above-described embodiment, by way of example the base unit 13 is constructed of an integrated structure comprised of the floor panel 14, rear stool member 15 and housing mount plate 17. However, the present invention is not limited to this particular example. For instance, the floor panel 14, rear stool member 15 and housing mount plate 17, which are formed separately of each other, may be assembled on the revolving frame 6.

Further, in the above-described embodiment, for the convenience of machining and assembling work, the seat supporting stool 22 is constituted by rear and front stool members 15 and 21 of the base unit 13. However, the present invention is not limited to this particular example. For instance, a seat supporting stool can be arranged as in a third modification of FIG. 14 or as in a fourth modification of FIG. 15.

Figure 14:
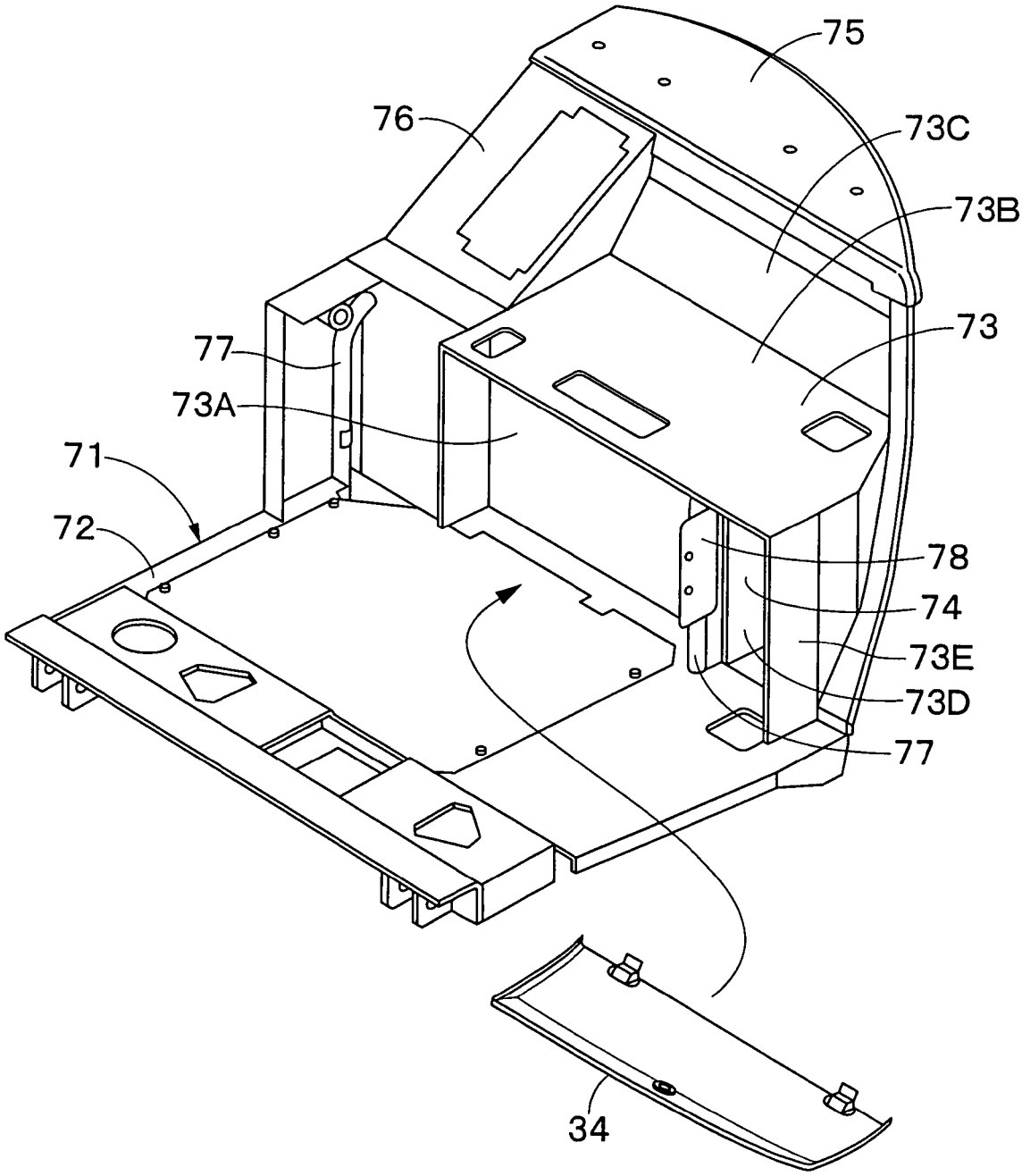
FIG. 14 is an exploded perspective view of a seat supporting stool member together with base unit and front cover according to a third modification of the present invention.

Namely, in the case of the third modification of FIG. 14, a base unit 71 can be constituted by an integrated structure comprised of floor panel 72, seat supporting stool 73, selector valve accommodation room 74, housing mount plate 75, instrument mount portion 76, reinforcing pipes 77 and mounting plate 78.

In this instance, the seat supporting stool 73 is constituted by a single structure which is formed by stretching a rear stool member forward, while abolishing the front stool member 21. More specifically, in this case, the seat supporting stool 73 is constituted by a riser wall portion 73A, seat supporting plate 73B, back portion 73C, partition plate 73D and left side plate 73E. A selector valve accommodation room 74 is defined between the partition plate 73D and the left side plate 73E.

Figure 15:
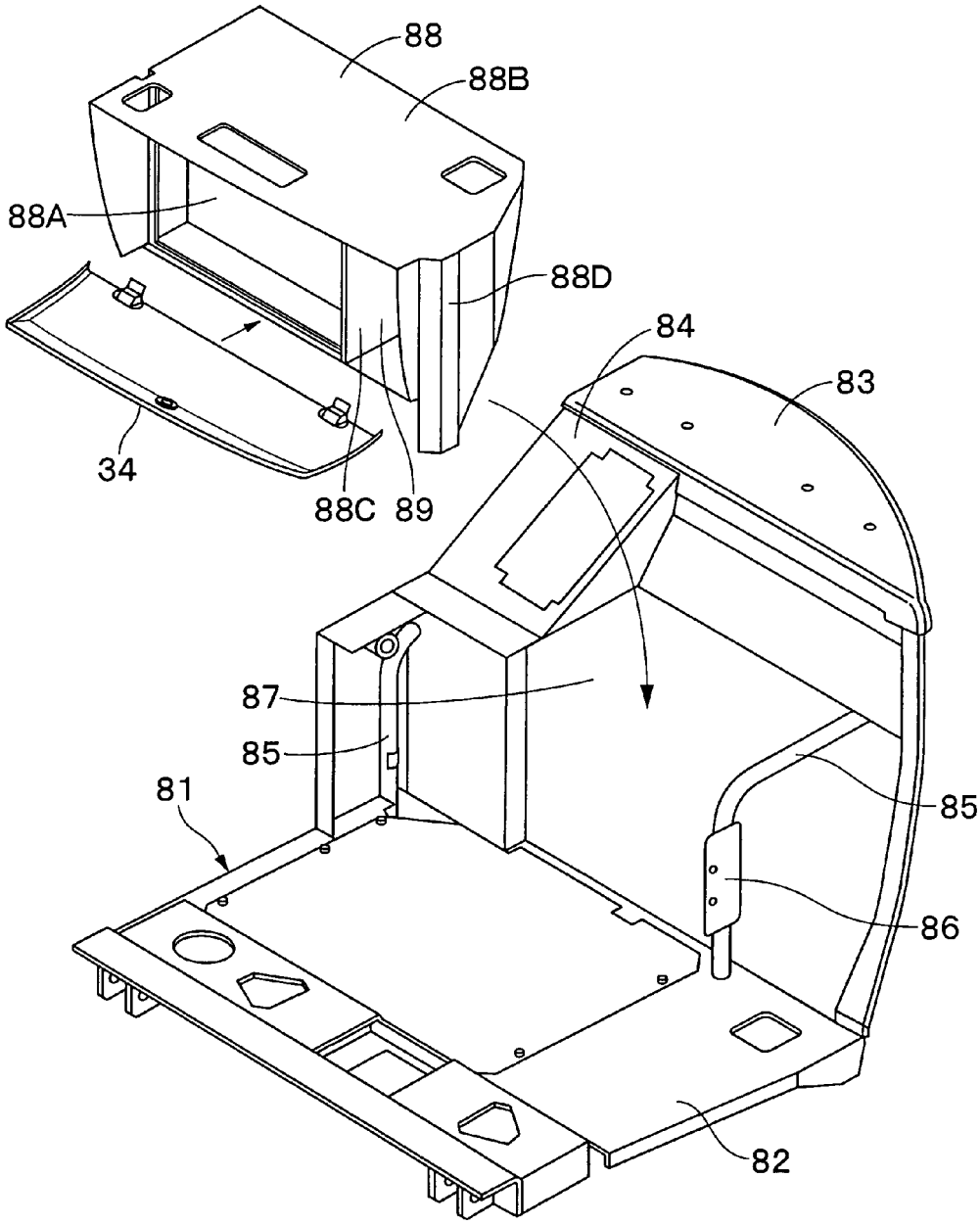
FIG. 15 is an exploded perspective view of a seat supporting stool member together with base unit and front cover according to a fourth modification of the present invention.

Further, as in the fourth modification of FIG. 15, a base unit 81 can be constituted by an integrated structure comprised of a floor panel 82, housing mount plate 83, instrument mount portion 84, reinforcing pipes 85 and mounting plate 86, and leaving a stool mounting space 87 between the floor panel 82 and the housing mount plate 83. A seat supporting stool 88 which is formed separately from the base unit 81 is fixedly and integrally mounted in the stool mounting space 87 of the base unit 81 by the use of a suitable fixation means.

In this instance, the seat supporting stool 88 is formed by integration of the rear and front stool members, and includes a riser wall 88A, seat supporting plate 88B, partition plate 88C and left side plate 88D. A selector valve accommodation room 89 is formed between the partition plate 88C and the left side plate 88D.

Further, in the above-described embodiment, the present invention is applied by way of example to a canopy type hydraulic excavator 1 which is furnished with a 4-post canopy 41 to hang over the operator's seat 23. However, application of the present invention is not limited to the particular example shown. For instance, the present invention can be similarly applied to a hydraulic excavator with a 2-, 3- or 5-post canopy or to a cab type hydraulic excavator which is furnished with a cab box which is enclosed on front, rear, right, left and top sides of the operator's seat 23.

Further, in the above-described embodiment, as a construction machine, the present invention is applied by way of example to a hydraulic excavator 1 with the upper revolving structure 4 which can be swung back and forth through the swing mechanism 3. However, application of the present invention is not limited to the particular example shown. The present invention can be similarly applied to the other construction machines, such as hydraulic excavator, wheel loader, lift truck or other construction machine which is not equipped with a swing mechanism.

The invention claimed is:

1. A construction machine having a vehicular body, a working mechanism liftably provided on a front portion of said vehicular body, a seat supporting stool provided on said vehicular body, an operator's seat mounted on said seat supporting stool to be taken by operator, control valves provided in the course of hydraulic ducts to control said working mechanism by operating oil supply and discharge from a hydraulic pressure source to said working mechanism, manual operating means provided in the vicinity of said operator's seat for operating said control valves to control said working mechanism, and a pattern selector valve provided between said manual operating means and said control valves to permit selection of an operating pattern of said manual operating means in relation with said control valves, wherein:

said pattern selector valve has a valve casing housing a directional control valve adapted to change over connections of oil passages between said manual operating means and said control valves, and a switch lever rotatably supported on said valve casing to permit selector operation of said directional control valve;

said seat supporting stool is adapted to accommodate said pattern selector valve in an inner space with said switch lever of said pattern selector valve, located at a front side of said seat supporting stool;

a front side of said seat supporting stool is provided with an openable front cover adapted to cover said pattern selector valve; and a check-out window is provided in said front cover to permit viewing there through of a current position of said switch lever of said pattern selector valve.

2. A construction machine as defined in claim 1, wherein said seat supporting stool is internally provided with a selector valve accommodation room for lodging said pattern selector valve therein.

3. A construction machine as defined in claim 2, wherein said selector valve accommodation room is partitioned in circumference with a box-like shape.

4. A construction machine as defined in claim 1, wherein said pattern selector valve is accommodated at a position on the side of an entrance way at one side of said operator's seat, and said check-out window in said front cover is located on the side of said entrance way and in a corresponding position relative to said switch lever of said pattern selector valve.

5. A construction machine as defined in claim 1, wherein a transparent member is fitted in said check-out window for covering purpose.

6. A construction machine as defined in claim 1, wherein a pattern indicator is provided in the vicinity of said check-out window in relation with switching positions of said switch lever of said pattern selector valve, showing selectable operating patterns of said manual operating means in relation with said control valves.

7. A construction machine as defined in claim 1, wherein a lock mechanism is provided on said front cover for locking same in a closed state.

8. A construction machine as defined in claim 1, further comprising pilot pressure ducts between said control valves and said manual operating means to supply a pilot pressure from hydraulic pilot valves of said manual operating means to hydraulic pilot portions of said control valve, and a relay assembly interposed between pilot pressure ducts on the side of said manual operating means and pilot pressure ducts on the side of said control valves.

9. A construction machine as defined in claim 8, wherein said seat supporting stool is mounted on a floor panel, and said relay assembly is located on the lower side of said floor panel.

10. A construction machine having a vehicular body, a working mechanism liftably provided on a front portion of said vehicular body, a seat supporting stool provided on said vehicular body, an operator's seat mounted on said seat supporting stool to be taken by operator, control valves provided in the course of hydraulic ducts to control said working mechanism by operating oil supply and discharge from a hydraulic pressure source to said working mechanism, manual operating means provided in the vicinity of said operator's seat for operating said control valves to control said working mechanism, and a pattern selector valve provided between said manual operating means and said control valves to permit selection of an operating pattern of said manual operating means in relation with said control valves, wherein:

said seat supporting stool is adapted to accommodate said pattern selector valve in an inner space with a switch lever located at a front side of said seat supporting stool;

a front side of said seat supporting stool is provided with an openable front cover adapted to cover said pattern selector valve; and a check-out window is provided in said front cover to check out current position of said switch lever of said pattern selector valve within said seat supporting stool, and further including pilot pressure ducts between said control valves and said manual operating means to supply a pilot pressure from hydraulic pilot valves of said manual operating means to hydraulic pilot portions of said control valve, and a relay assembly interposed between pilot pressure ducts on the side of said manual operating means and pilot pressure ducts on the side of said control valves.

* * * * *